US007226329B2

(12) United States Patent
Railey

(10) Patent No.: US 7,226,329 B2
(45) Date of Patent: Jun. 5, 2007

(54) POWERED SURFBOARD

(76) Inventor: Mike R. Railey, 14098 Mango Dr., Del Mar, CA (US) 92014

( * ) Notice: Subject to any disclaimer, the term of this patent is extended or adjusted under 35 U.S.C. 154(b) by 0 days.

(21) Appl. No.: 11/263,505

(22) Filed: Oct. 31, 2005

(65) Prior Publication Data

US 2006/0094310 A1 May 4, 2006

Related U.S. Application Data

(60) Provisional application No. 60/624,455, filed on Nov. 1, 2004.

(51) Int. Cl.
*A63C 5/03* (2006.01)

(52) U.S. Cl. ..... 441/74

(58) Field of Classification Search ..... 441/74; 440/6; 446/154
See application file for complete search history.

(56) References Cited

U.S. PATENT DOCUMENTS

| | | | | |
|---|---|---|---|---|
| 4,020,782 | A | 5/1977 | Gleason | |
| 4,538,996 | A | 9/1985 | Inwood | |
| 5,017,166 | A | 5/1991 | Chang | |
| 5,396,860 | A | 3/1995 | Cheng | |
| 5,429,562 | A | 7/1995 | Milner | |
| 5,590,616 | A | 1/1997 | Vera | |
| 5,807,152 | A | 9/1998 | Wojcik | |
| 5,947,788 | A | 9/1999 | Derrah | |
| 6,142,840 | A | 11/2000 | Efthymiou | |
| 6,183,333 | B1 * | 2/2001 | Hall | 446/154 |
| 6,250,977 | B1 | 6/2001 | Ness | |
| 6,305,307 | B1 | 10/2001 | Yokoya | |
| 6,409,560 | B1 | 6/2002 | Austin | |
| 6,461,204 | B1 | 10/2002 | Takura et al. | |
| 6,568,340 | B2 * | 5/2003 | Dec et al. | 114/55.56 |
| 6,662,742 | B2 * | 12/2003 | Shelton et al. | 114/312 |
| 6,702,634 | B2 | 3/2004 | Jung | |
| 6,793,552 | B2 | 9/2004 | Derrah | |
| 6,823,813 | B2 * | 11/2004 | Mazin | 114/315 |
| 6,901,872 | B1 | 6/2005 | Battle et al. | |
| 2002/0072285 | A1 * | 6/2002 | Jung | 441/74 |
| 2003/0167991 | A1 * | 9/2003 | Namanny | 114/55.56 |

* cited by examiner

*Primary Examiner*—Stephen Avila
(74) *Attorney, Agent, or Firm*—Knobbe, Martens, Olson & Bear LLP

(57) ABSTRACT

A motorized surfboard with substantially flat and smooth top and bottom surfaces, a maximum thickness of three inches or less and no protruding parts other than fins extending from a rear, bottom portion of the surfboard. The motorized surfboard is configured to perform in substantially the same manner as a traditional surfboard and is unaffected by the presence of a motor other than the improved performance by the thrust provided. Further provided is a motorized surfboard configured with an electric motor of the type used in toy boats and planes. The motor may be controlled by signals from a throttle embedded in the surfboard and which may be hand controlled by a rider of the surfboard.

18 Claims, 3 Drawing Sheets

POWERED SURFBOARD

CROSS-REFERENCE TO RELATED APPLICATIONS

This application claims priority to U.S. Provisional Application No. 60/624,455 filed on Nov. 1, 2004 and incorporates said provisional application by reference in its entirety.

BACKGROUND OF THE INVENTION

1. Field of the Invention

The present invention relates to a motor driven surfboard.

2. Description of the Related Art

Surfing is the sport of riding a surfboard (heavy timber "plank", fiberglass, light wood or foam board) on the face of an ocean wave towards the shoreline. Jet powered surfboards have been devised and utilized for the purpose of surfing without waves such as in lakes or other calm waters. Several types of motorized water boards in the prior art include U.S. Pat. No. 6,702,634 to Jung; U.S. Pat. No. 6,409,560 to Austin; U.S. Pat. No. 6,142,840 to Efthymiou; U.S. Pat. No. 5,017,166 to Chang; and U.S. Pat. No. 4,020,782 to Gleason.

SUMMARY OF THE INVENTION

In one embodiment, a powered surfboard comprises a body having substantially flat and smooth top and bottom surfaces, a maximum thickness of three inches or less and no protruding parts other than fins extending from a rear, bottom portion of the body. This embodiment also comprises at least one impeller connected to at least one electric motor. The impeller and the electric motor are contained primarily within the body of the surfboard. Further, the performance of the surfboard when riding waves in a traditional manner is relatively unaffected by the presence of the impeller and the electric motor while the ability to paddle, catch and ride waves is enhanced by the extra forward thrust provided.

In another embodiment, a motor driven surfboard comprises a body having substantially flat and smooth top and bottom surfaces, a maximum thickness of three inches or less, and no protruding parts other than fins extending from a rear, bottom portion of the body. This embodiment also comprises at least one electric motor that has power and performance suitable for toy radio controlled vehicles. The electric motor in this embodiment is connected to at least one impeller.

In another embodiment, a motor driven surfboard comprises a body having substantially flat and smooth top and bottom surfaces, a front end, a maximum thickness of three inches or less, and no protruding parts other than fins extending from a rear, bottom portion of the body. This embodiment also comprises at least one electric motor of approximately 150 to 450 watts output power. Further, the electric motor is connected to at least one impeller.

In another embodiment, a motor driven surfboard comprises a body having substantially flat and smooth top and bottom surfaces, a front end, a maximum thickness of three inches or less, and no protruding parts other than fins extending from a rear, bottom portion of the body and a throttle control extending less than one inch from the body. This embodiment also comprises at least one impeller and at least one toy electric motor. In this embodiment, the toy electric motor is connected to a motor controller and the motor controller is controlled by the throttle control. Further, in this embodiment the throttle control is embedded within the body of the surfboard and is configured to allow hand-operation of the throttle control.

DETAILED DESCRIPTION OF THE PREFERRED EMBODIMENT

Traditionally, the sport of surfing comprises a rider ("surfer") "paddling out" by lying prone on the surfboard and paddling away from the shoreline towards a point at which waves are cresting; turning to face the shoreline; paddling quickly towards the shoreline when a wave begins to crest so as to "catch the wave"; and "riding the wave" on the surfboard propelled by the wave towards the shoreline in a prone, sitting or standing position. When riding a wave, a surfer may turn the surfboard towards or away from different parts of the cresting wave depending on the preference and skill of the surfer. Subsequently, the surfer must paddle out and repeat the process of catching and riding waves. After catching and riding waves for a period of time, the surfer must "paddle in" by lying prone on the surfboard and paddling towards the shoreline to end the sport of the surfing for the day. Paddling out, turning, paddling quickly to catch waves and paddling in can be tiring and time consuming to the surfer and can thus limit the surfer's energy and time for riding waves. Advantageous embodiments of the present invention preserve a surfer's maximum energy for riding waves rather than exhausting the surfer's energy on paddling.

Jet powered motorized surfboards have been used for the purpose of surfing without the need for waves, such as in lakes or other calm waters. The general purpose of the present invention, which will be described in greater detail below, is to provide a motorized surfboard which has the advantages of traditional surfboard design, with increased performance and function without many of the disadvantages of the motor driven surfboards, wakeboards, boogie boards, belly boards, personal watercraft, etc. in the prior art.

Figure 1:
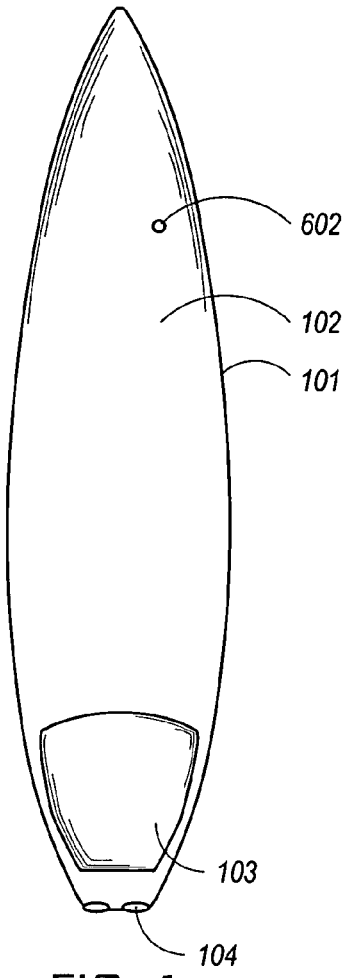
FIG. 1 is a top view of one embodiment of the motorized surfboard.
Figure 2:
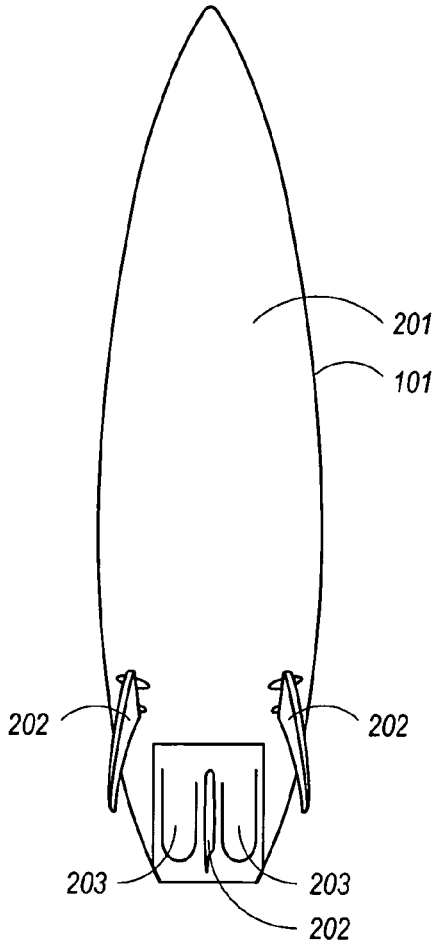
FIG. 2 is a bottom view of one embodiment of the motorized surfboard.
Figure 3:
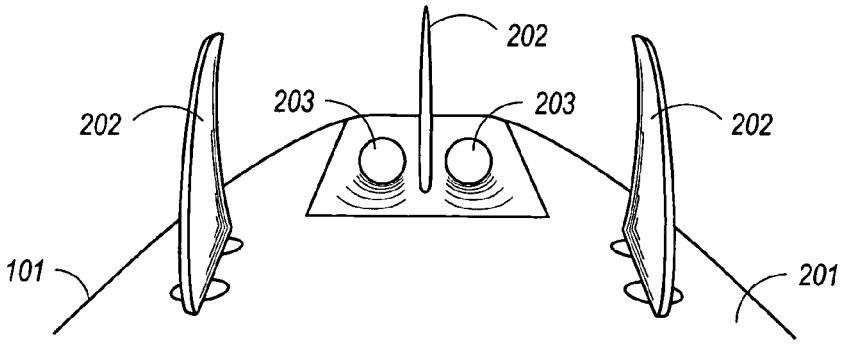
FIG. 3 is a bottom view of the tail portion of one embodiment of the motorized surfboard.
Figure 4:
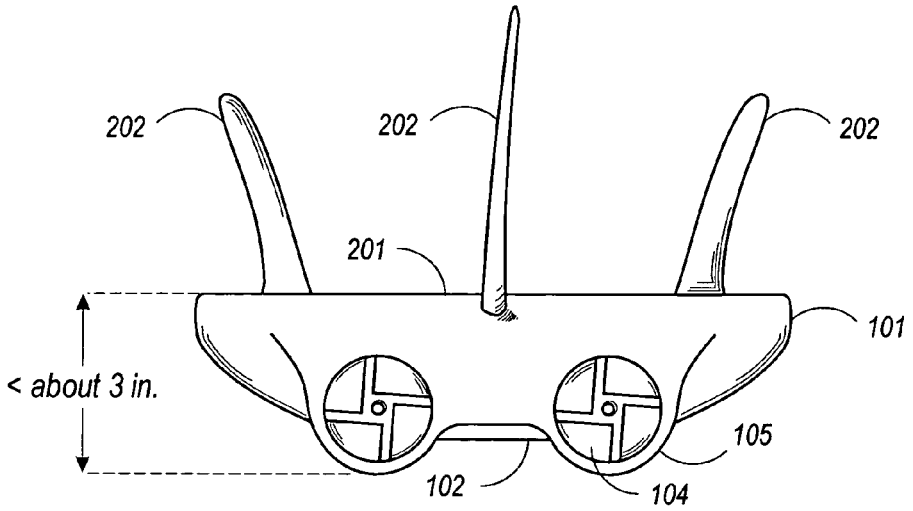
FIG. 4 shows an upside-down view of the tail end of one embodiment of the motorized surfboard.

In advantageous embodiments, a motorized surfboard body 101 has substantially flat and smooth top 102 and bottom 201 surfaces, a maximum thickness of approximately three inches and no substantial protruding parts other than fins 202 extending from the bottom of the tail portion of the body of the surfboard 101. The body of the surfboard 101 may be elongated, rounded or square shaped. In advantageous embodiments the body of the surfboard 101 is an oblong, traditional surfboard shape and comprises a nose, a tail and left and right rails. Generally, the body of the surfboard 101 will be made from wood, fiberglass or foam board, although other types of strong, low density materials may also be used. FIG. 1 shows the body of the surfboard 101 with a top surface 102 and essentially no protruding parts from the top surface 102. FIG. 1 shows the tail of the surfboard in this embodiment with a stomp pad 103 where a surfer may stand on the board when riding waves. FIG. 2 shows the body of the surfboard 101 with a bottom surface 201 and no substantial protruding parts other than fins 202. FIG. 3 shows the body of the surfboard 101 with a bottom surface 201 with no substantial protruding parts other than fins 202. FIG. 4 shows the body of the surfboard 101 as well as the top surface 102 and the bottom surface 201 with no substantial protruding parts other than fins 202. The drawing of this embodiment also shows a gentle curvature of the generally flat and smooth top surface 102 towards the sides of the surfboard.

Some embodiments of the present invention use at least one impeller 501. Advantageously, an impeller 501 comprises rotating blades attached to a hub contained within a tube. The impeller 501 is attached to an electric motor or motors 502 via a motor shaft or a coupler 508. The motor shaft or a coupler 508 allows the electric motor or motors 502 to rotate the blades of the impeller 501 so that when the surfboard is floating in water, water will enter into impeller tube entrance holes 203 and exit out of impeller tube exit holes 104. In some advantageous embodiments, an impeller or plurality of impellers 501 is encased within the body of the surfboard in such a way that water will have access to enter the impeller tube entrance hole 203 and exit the impeller tube exit hole 104. When in combination with an electric motor or motors 502, the impeller or plurality of impellers 501 will force water out of impeller exit holes 104 and propel the surfboard and/or a surfboard and rider combination generally in a forward direction when the surfboard body 101 is floating in water.

FIGS. 1–4 show various physical features of advantageous embodiments of the impeller tubes of the motorized surfboard. FIG. 1 shows the tail of the surfboard where impeller tube exit holes 104 in this particular embodiment allow water to be expelled and thus propel the surfboard in a forward direction when the surfboard is floating in water. FIG. 2 shows the impeller tube entrance holes 203 as recessed openings in the bottom of the tail portion of this particular embodiment. The impeller tube entrance holes 203 allow water to enter the impellers 501 when the surfboard is floating in water. FIG. 3 shows impeller tube entrance holes 203 as recessed openings in the bottom portion of the tail of the surfboard body 101 in this particular embodiment. FIG. 4 shows one embodiment of the motorized surfboard that positions impeller tube exit holes 104 in the tail of the surfboard. FIG. 4 also shows one way in which the impellers 501 may be embedded within the body of the surfboard 101 without significantly interfering with the relatively flat and smooth top surface 102 of the surfboard.

In some embodiments, impellers 501 may be advantageously placed in the front, side or rear portion of the surfboard body 101 depending on the type of control desired by the surfboard rider when riding a motorized surfboard. In some embodiments an impeller 501 connected to a motor 502 may be partly contained within some portion of one or more fins 202 protruding from the body of the surfboard 101. In some advantageous embodiments the impeller-electric motor combination is contained primarily within the body of the surfboard 101; thus, the body of the surfboard 101 will encase 105 the impeller 501 and the electric motor 502 such that a protrusion or disturbance of the flat surface of the board will be minimal—e.g. not greater than the radius of an impeller 501 or of an electric motor 502. In the case of a protrusion or disturbance in the otherwise flat surface of the board 102, that protrusion or disturbance will not affect the performance of the surfboard when engaged in a traditional form of surfing. An impeller-motor combination may be configured to propel an otherwise stationary surfboard in a reverse direction, such as for purposes of braking, if desired. Types of impellers 501 may include water jets with reverse bucket and excess reinforcement fins removed. Jet drives or impellers such as those types used in and adopted for use in toy model boats are also appropriate.

In some advantageous embodiments of the present invention a motorized surfboard may be propelled by at least one lightweight electric motor 502. In some embodiments the electric motor has adequate power to propel a surfboard and rider combination in water when paddling out, turning, catching waves, riding waves or paddling in. An acceptable electric motor may have power and performance characteristics similar to those used in toy model boats and/or model airplanes. Acceptable electric motors 502 include those of a brushless DC type or types comprising components originally designed for radio controlled hobby vehicles. In some advantageous embodiments, the electric motor(s) 502 is rated at approximately 150 to 450 watts.

Advantageously, the electric motor or motors 502 are embedded in the surfboard body 101. In some embodiments the electric motor 502 is completely enclosed within the surfboard body. Within the surfboard body 101 the electric motor 502 is coupled to an impeller or plurality of impellers 501 as described above. The electric motor or motors 502 in combination with the impeller or impellers 501 are configured to propel the surfboard when the surfboard is floating in water as described above.

In advantageous embodiments the electric motor or motors 502 receive power from a power source 506. Acceptable sources of power include a lithium battery or plurality of lithium batteries capable of generating approximately 70 amps of current embedded in the body of the surfboard. A power source 506 including LiPo batteries may provide sufficient electrical current to power to the electric motor 502 coupled to an impeller 501. Types of batteries used as a power source 506 might include a 3 cell 860 mAh, 11.1 V LiPoly Pack with a JST connector, a 3 cell 2100 mAh, 11.1 V High Discharge LiPoly Pack with 16 gauge wire, or one or more 3S2P 4200 mAh, 11.1 V LiPoly Pack with 16 gauge wire. A series connector module 505 may be used to connect multiple lithium battery packs and maximize voltage output to the motor or motors 502.

In some advantageous embodiments the electric motor or motors 502 connect to a motor controller 503. The motor controller 503 is embedded into either the nose or tail portion of the body of the surfboard such that the motor controller 503 does not protrude from the body of the surfboard 101 in such as way as to interfere with the performance of the surfboard during traditional surfing. Advantageously, the motor controller 503 connects to a receiver 504, such as a radio receiver, using a splitter. A basic splitter is a transformer-like device comprising a ferrite core and windings of fine wire, which accepts a single signal stream and splits it into identical parts that are each diminished in strength. The radio receiver 504 and splitter are embedded in the body of the surfboard 101 so that neither interferes with the generally flat and even top 102 and bottom 201 surfaces of the motorized surfboard.

Figure 5:
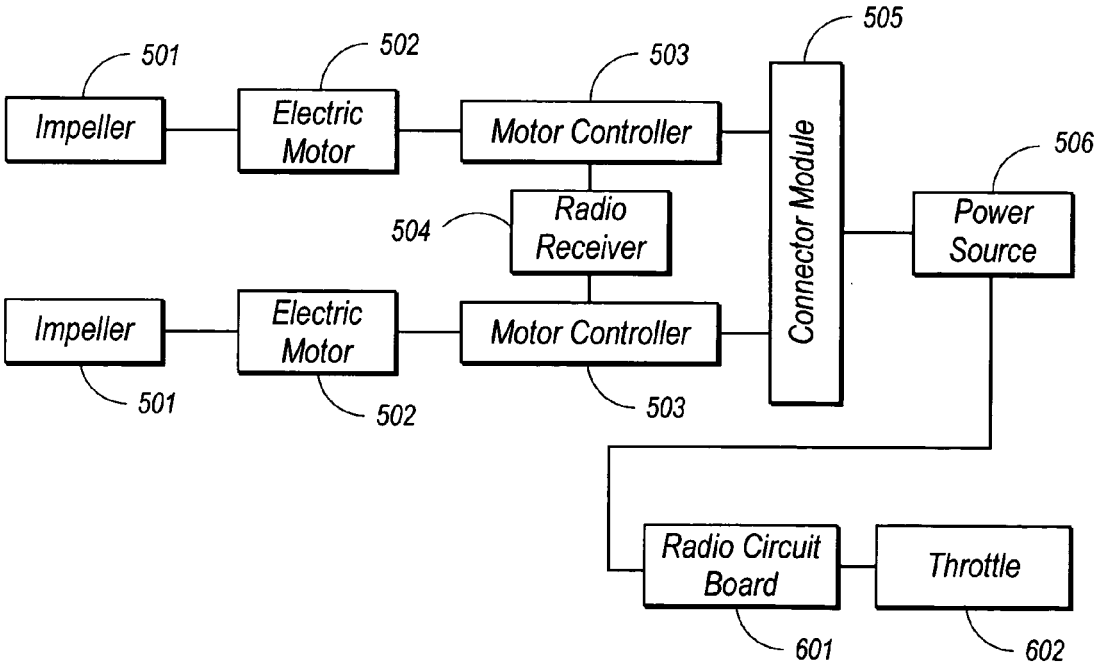
FIG. 5 is a block drawing showing a configuration of one embodiment of the drive system, which may be placed within the motorized surfboard.

In another advantageous embodiment, a motorized surfboard is configured so that the motor controller 503 connected to the receiver 504 may receive radio signals from a radio transmitter circuit board 601 connected to a throttle 602. Acceptable radio control circuit boards 601 and throttles 602 may be obtained from dismantling a pistol grip radio. The radio transmitter circuit board 601 may be of the type found in RC remote controllers. FIG. 5 shows impellers 501 connected to electric motors 502 controlled by motor controllers 503. FIG. 5 also shows motor controllers 503 connected to a connector module 505 that receives power from a power source 506. Motor controllers 503 in FIG. 5 are additionally connected to a radio receiver 504 that receives radio signals from a radio circuit board 601, which is connected to a throttle 602.

In some embodiments the radio circuit board 601 is embedded within the body of the surfboard 101 such that it does not protrude or significantly disturb the otherwise even surface of either the top 102 or bottom 201 surfaces of the motorized surfboard. In some embodiments the throttle 602 is embedded in the body of the surfboard 101, but is not completely encased within the body of the surfboard 101. In those embodiments, the throttle 602 protrudes sufficiently from the top 102 or bottom 201 surface of the surfboard body 101 to allow hand operation of the throttle 602 by a surfer when the surfer is riding the surfboard in a sitting or prone position. In some advantageous embodiments the throttle 602 may be customized with a dowel and a dimmer switch to allow for throttle control via twisting of the dowel. In some advantageous embodiments the throttle 602 may be a customized throttle knob embedded so as to be flush with or slightly protrude from the body of the surfboard 101, and which may still allow for throttle control by a surfer.

Figure 6:
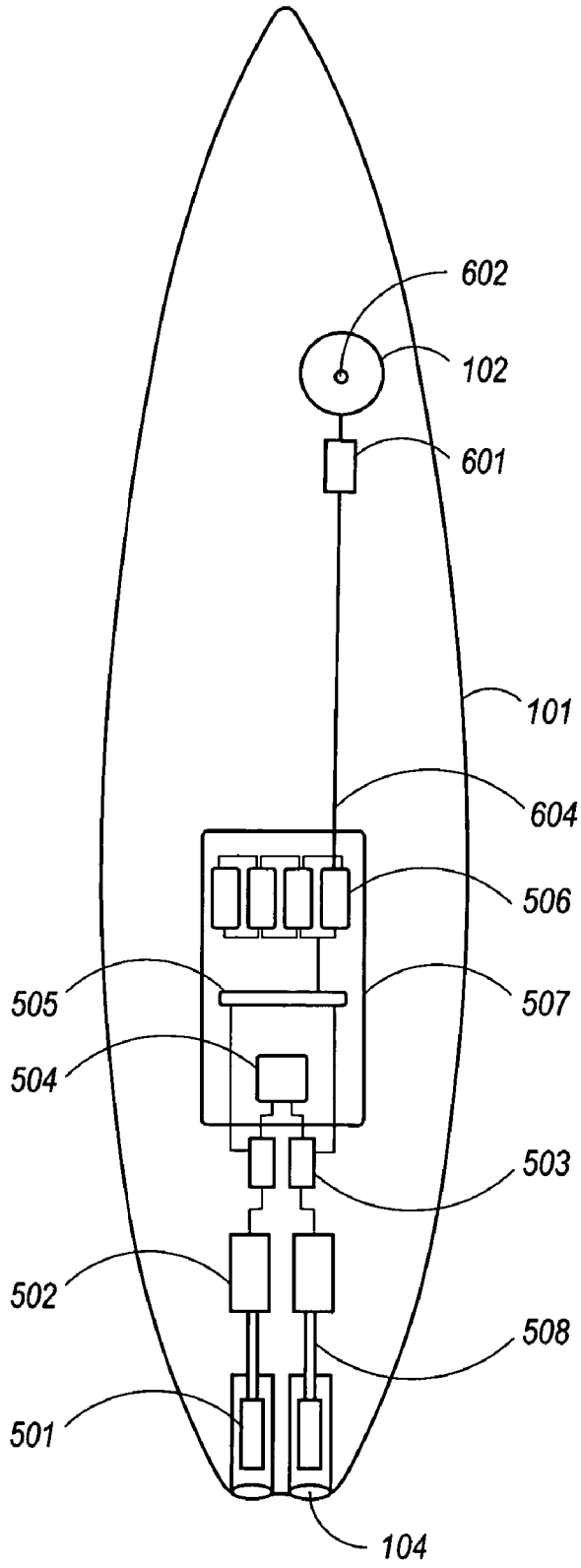
FIG. 6 is a drawing of the interior portions of one embodiment of the motorized surfboard.

FIG. 6 shows the surfboard with one arrangement of the motorized components within the body of the surfboard 101 that would power this embodiment of a motorized surfboard. In FIG. 6 impeller tube exit holes 104 are built into the body of the surfboard 101. FIG. 6 shows impellers 501 are connected to electric motors 502 controlled by motor controllers 503. Within a dry box area 507 a connector module 505 is connected to a power source 506. Additionally in FIG. 6 the connector module 505 is connected to a radio receiver 504, which receives signals transmitted from a radio circuit board 601 connected to a throttle 602. In some embodiments the throttle 602 is located in the nose of the surfboard and protrudes slightly from the top surface of the board 102. The radio circuit board 601 in FIG. 6 is connected to a power source via wires 604 embedded within the surfboard body 101. In other embodiments, the throttle 602 is connected directly to the motor controller 503 without the use of the radio circuit board 601 or the radio receiver 504.

In some advantageous embodiments a throttle 602 may also be connected directly to a motor controller 503 via a regulator and switch combination. The motor controller 503 may be thus configured to receive signals from the throttle 602 via the regulator and switch. In those embodiments, neither a radio receiver 504, nor a radio circuit board 601 is present. At least one electric motor is connected to a motor controller, which is connected to a receiver.

In some embodiments a radio control circuit board 601 in combination with a throttle 602 may also be hand held. In such an embodiment, the hand held radio controlled circuit board 601 and throttle 602 may allow hand operation of the throttle either by a surfer riding in a sitting or prone position on the surfboard or by a surfer or other person not riding on the surfboard. In such an embodiment, a throttle 602 may be customized with a dowel and a dimmer switch to allow for power control of the electric motor or motors via twisting the dowel.

In some advantageous embodiments the throttle 602 is configured to control the electric motor or motors 502 connected to the impeller or plurality of impellers 501. In those embodiments, the impellers will propel the surfboard body 101 when the surfboard body 101 is floating in water. Thus, in those embodiments, the throttle control 602 will control the propulsion of the surfboard.

In some advantageous embodiments, holes are cut or otherwise formed into the body of the surfboard 101 to accommodate each impeller 501, electric motor 502, motor controller 503, power source 506, receiver 504, circuit board 601, and throttle 602 combination. A dry box area 507 may house the power source 506 and/or a combination of other components. In embodiments in which a battery power source 506 is located within the dry box 507, the dry box 507 may allow for easy access to the battery or batteries for recharging purposes. In some embodiments a watertight recharge nipple may be embedded in the body of the surfboard to allow for recharging of the battery or batteries without opening the dry box 507 or removing the battery or batteries embedded within the body of the surfboard 101. After placing each impeller 501, electric motor 502, motor controller 503, power source 506, receiver 504, circuit board 601, and throttle 602 into the holes cut into the surfboard body 101, the holes may be foamed where there are no moving parts then sealed with wood, resin foam etc. The exterior of the surfboard body 101 may then be glassed and finned.

In one advantageous embodiment a motorized surfboard is designed as and configured to perform as a traditional surfboard. It will be appreciated that the present invention does not have a heavy bulky design or the presence of an outboard motor that might inhibit the safety and performance of the motorized surfboard in the manner of traditional surfing. In advantageous embodiments, the motorized surfboard will nevertheless have all of the capabilities and characteristics of a traditional surfboard; advantageous embodiments will improve the surfer's ability to catch and ride waves by the extra forward thrust provided, and will act and ride like a traditional surfboard. Advantageous embodiments will also avoid significant drag from protruding parts or significant deviation from a traditionally flat, smooth surfboard design.

What is claimed is:

1. A powered surfboard comprising:

a body having substantially flat and smooth top and bottom surfaces, a maximum thickness of three inches or less and no substantial protruding parts other than fins extending from a rear, bottom portion of said body; and at least one impeller connected to at least one electric motor, wherein both said at least one impeller and said at least one electric motor are contained primarily within said body of said surfboard, and wherein said surfboard's performance is substantially unaffected by the presence of said impeller and said electric motor and wherein an ability to paddle, catch and ride waves is enhanced by a forward thrust provided by said impeller and said electric motor.

2. The surfboard of claim 1, wherein said at least one impeller comprises:

one or more blades;

said blades attached to a hub;

said blades and hub contained within a tube with two openings such that said blades rotate on said hub to force water entering one opening of said tube out of the other opening of said tube.

3. The surfboard of claim 1 wherein said at least one motor is of a brushless DC type.

4. The surfboard of claim 1 wherein said at least one impeller connected to at least one motor is configured to propel said surfboard when said surfboard is floating in water.

5. The surfboard of claim 4 wherein said at least one impeller is placed near said rear portion of said surfboard.

6. A motor driven surfboard comprising:

a body having substantially flat and smooth top and bottom surfaces, a maximum thickness of three inches or less, and no substantial protruding parts other than fins extending from a rear, bottom portion of said body;

at least one electric motor having power and performance suitable for toy radio controlled vehicles; and said at least one electric motor connected to at least one impeller.

7. The surfboard of claim 6 wherein said at least one impeller and said at least one electric motor are contained within the thickness of said surfboard body.

8. A motor driven surfboard comprising:

a body having substantially flat and smooth top and bottom surfaces, a front end, a maximum thickness of three inches or less, and no substantial protruding parts other than fins extending from a rear, bottom portion of said body;

at least one 150 to 450 watt electric motor;

said at least one electric motor connected to at least one impeller.

9. The surfboard of claim 8 wherein said at least one impeller and said at least one electric motor are contained within the thickness of said surfboard body.

10. A motor driven surfboard comprising:

a body having substantially flat and smooth top and bottom surfaces, a front end, a maximum thickness of three inches or less, and no substantial protruding parts other than fins extending from a rear, bottom portion of said body;

a throttle control;

at least one impeller;

at least one electric motor adapted for use in toy boats;

said at least one electric motor connected to a motor controller;

said motor controller is controlled by said throttle control; and said throttle control embedded within said body and configured to allow hand-operation of said throttle control.

11. The surfboard of claim 10 wherein said motor controller is configured with a radio control circuit board to receive radio signals from said throttle control.

12. The surfboard of claim 10 wherein said motor controller is configured with a regulator and switch to receive signals from a throttle control.

13. The surfboard of claim 10 wherein said at least one impeller and said at least one electric motor are contained within the thickness of said surfboard body.

14. The surfboard of claim 10 wherein said at least one motor is of a brushless DC type.

15. The surfboard of claim 11 wherein said radio transmitter control circuit board is adapted for use in standard RC remote controllers.

16. The surfboard of claim 10 wherein said throttle control is placed near said front end of said surfboard.

17. The surfboard of claim 10 wherein said at least one impeller is placed near said rear portion of said surfboard.

18. The surfboard of claim 10 wherein said throttle control is substantially flush with the surface of the body of the surfboard.

* * * * *